United States Patent [19]

Nicol et al.

[11] 4,209,301

[45] Jun. 24, 1980

[54] TREATMENT OF COAL SLURRIES

[75] Inventors: Stuart K. Nicol, Kotara South; Andrew R. Swanson, Waratah, both of Australia

[73] Assignee: The Broken Hill Proprietary Company Limited, Melbourne, Australia

[21] Appl. No.: 903,580

[22] Filed: May 8, 1978

[30] Foreign Application Priority Data

May 10, 1977 [AU] Australia ..... PD0044

[51] Int. Cl.[2] ..... C10L 5/14; C10L 5/40; C10L 5/00

[52] U.S. Cl. ..... 44/24; 44/6; 44/10 R; 44/23

[58] Field of Search ..... 44/10 R, 6, 24, 23; 75/3

[56] References Cited

U.S. PATENT DOCUMENTS

| | | | |
|---|---|---|---|
| 1,929,860 | 10/1933 | Trent | 44/24 X |
| 1,960,917 | 5/1934 | Magelvoort | 44/6 |
| 3,775,070 | 11/1973 | Messer et al. | 44/10 R |
| 3,856,668 | 12/1974 | Shubert | 210/21 |
| 4,018,571 | 4/1977 | Cole et al. | 44/6 X |

*Primary Examiner*—Carl F. Dees

*Attorney, Agent, or Firm*—Murray and Whisenhunt

[57] ABSTRACT

A process of agglomerating coal from coal fines is disclosed, wherein an aqueous slurry of coal fines is mixed with oil without intensive agitation, and thereafter the resulting coal fines agglomerates are removed from the slurry. The process unexpectedly produces higher selective agglomeration than prior art processes utilizing high shear energy input conditions.

12 Claims, 6 Drawing Figures

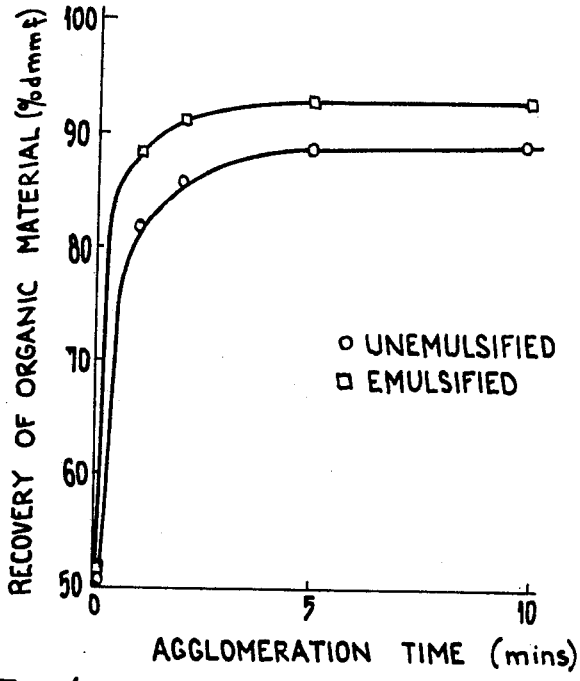
FIG. 1. THE INFLUENCE OF AGGLOMERATION TIME ON THE RECOVERY OF ORGANIC MATTER.
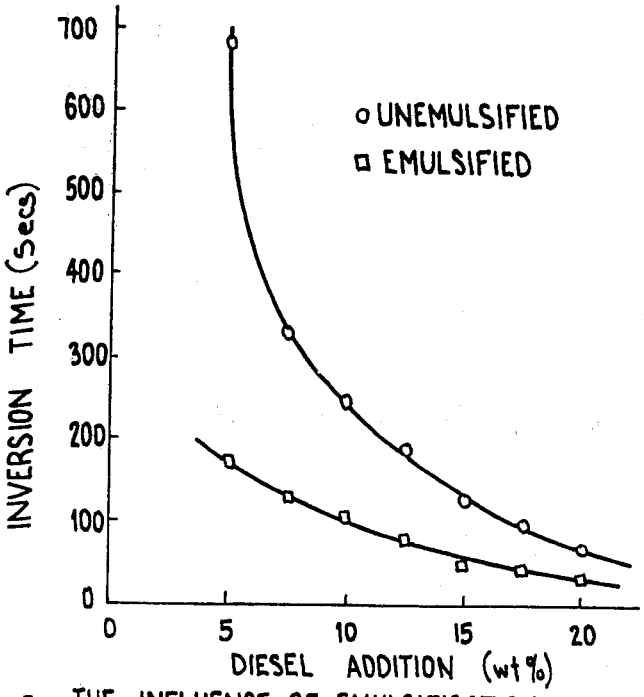
FIG. 2. THE INFLUENCE OF EMULSIFICATION ON INVERSION TIME.

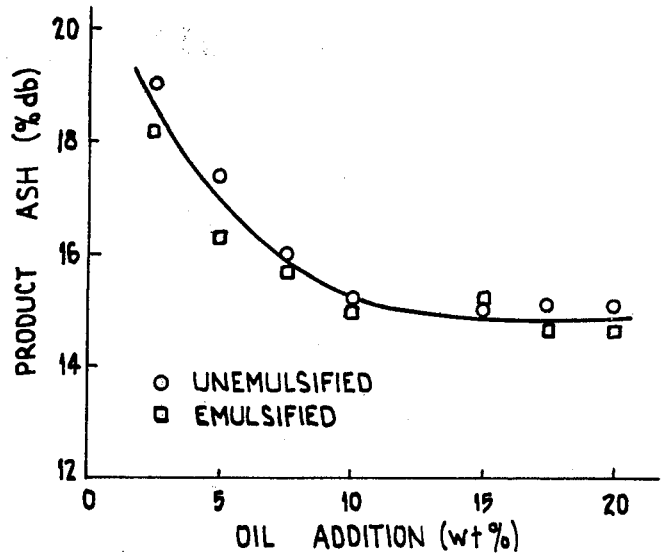
FIG. 3. THE INFLUENCE OF EMULSIFICATION ON PRODUCT ASH
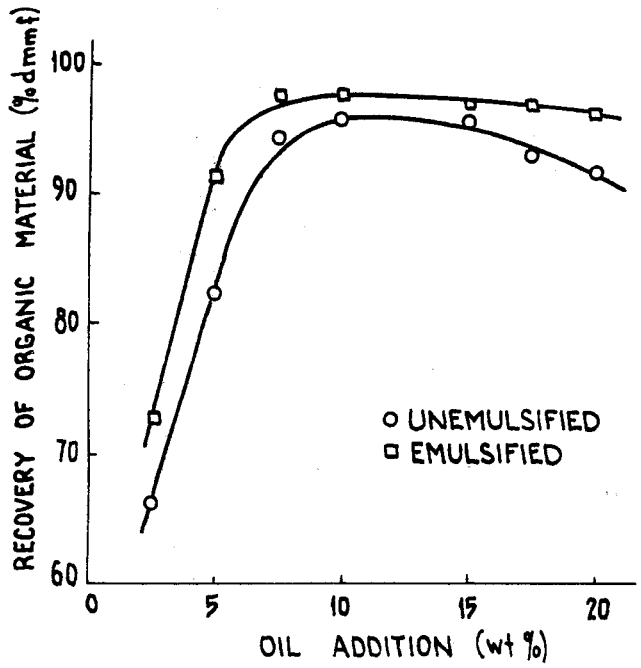
FIG. 4. THE INFLUENCE OF EMULSIFICATION ON PRODUCT RECOVERY

TREATMENT OF COAL SLURRIES

The rapid depletion of traditional energy sources such as the fossil fuels has focussed attention on the need for more efficient utilisation of those fuels. In particular, the efficient utilisation of coal has recently assumed special importance in view of the projected exhaustion of oil supplies.

The present invention is directed to a significant improvement in the utilisation of coal.

In the processing of coal prior to its utilisation, a large proportion of all mined coal is subjected to a wet washing treatment. In such treatments, finely divided coal is lost in the waste water stream, together with other, usually inorganic, matter.

In addition to the loss of valuable coal, disposal of coal-bearing wastes has resulted in environmental pollution, concerning which public opinion has become increasingly vocal in recent years, often resulting in the imposition of statutory restrictions that can only be complied with at substantial expense, if indeed compliance is at all possible.

One of the objects of this invention is to provide a process for the recovery of useful coal from waste streams containing finely divided coal and other matter. At the same time, operation of the process according to the invention will substantially alleviate the environmental pollution formerly associated with disposal of those coal-bearing wastes.

All conventional coal washing processes currently in commercial use have the common feature of producing reject tail slurries which often contain substantial quantities of ultrafine coal. These tailings represent a loss in total recoverable coal as well as being environmentally unacceptable.

Some attempts have been made in the past to recover these ultrafine coals by froth flotation but costs have proved prohibitive. Extremely low pulp densities (of the order of 2 to 5% w/w) have been required to effect even partial recovery of the contained coal. In addition, because of the fine nature of the coal recovered by this method, the clean coal product exhibits poor filtration properties leading to high filter cake moistures and attendant poor handling characteristics. Consequently froth flotation has failed to provide an economically acceptable process.

An alternative proposal is a process known as selective agglomeration, in which coal is extracted from the aqueous tailing slurry using an oil phase. This process relies on the fact that high rank coal is hydrophobic and so when the coal is agitated with a mixture of oil and water, it preferentially collects in the oil phase leaving the hydrophilic gangue materials in aqueous suspension. Selective agglomeration has also failed to gain acceptance for economic reasons, including:

(a) the high cost of oil (b) the low market price of coal fines (c) the mechanical difficulties associated with the separation of the agglomerated product (d) the high energy requirements necessary to cause phase separation.

Although a number of commercial or semicommercial plants operating on this principle exist or have existed, a wider acceptance of the process has been prevented in the past by the abovementioned adverse economic factors.

The differences between the various forms of the process that have been attempted in practice rest mainly in the mechanical means used to produce phase separation and to separate the products.

The supposed high energy requirements needed to cause phase separation in a stirred tank are reflected in the widespread adoption of high speed stirrers (>10,000 r.p.m.) in both laboratory work and in many of the proposed flow sheets; see for examples Capes, C. E., et al, *Application of Spherical Agglomeration to Coal Preparation,* Seventh Int. Coal Prop. Congress, Sydney, Australia, 1976 Pap. H2., and Lemke, K., *The Cleaning and Dewatering of Slurries by the Convertol Process,* Second Int. Coal Prep. Congress, Essen, Germany, 1954. These pieces of equipment have been considered necessary to cause efficient distribution of the oil over the surfaces of the coal particles in such a way as to minimise problems arising from slime coatings and to permit "pendular flocculation" i.e. the formation of pendular bridges of oil between contacting coal particles.

From a mechanistic viewpoint it seems likely that such oil particle contacts could be greatly enhanced if the oil phase was first emulsified prior to its introduction to the raw pulp. Indeed, this is claimed to be the case in the "emulsion flotation" process and in a variation of the selective agglomeration process described by Shubert in the U.S. Pat. No. 3,856,668. However, even in this instance, the use of emulsions appears to have been adopted on an ad hoc basis and very little information is available on the fundamental principles involved or on the relevant process parameters.

Our researches into this field have now established that the efficiency of the selective agglomeration process is dependent upon several parameters. A most significant and unexpected finding is that superior results are achieved when the shear regime in the reactor involves lower energy input, contrary to previously held beliefs that intense mixing was essential and the higher the energy input, the better. As will appear hereinafter, we have established in a preferred aspect of the invention that by suitable choice of other parameters, including those associated with pre-emulsification of the oil, selective agglomeration can be successfully achieved by injecting the emulsion into a raw coal pulp stirred at only sufficient speed to ensure mixing.

In the accompanying drawings:

FIG. 1 illustrates the influence of agglomeration time on the recovery of organic matter.

FIG. 2 illustrates the influence of emulsification on inversion time.

FIG. 3 illustrates the influence of emulsification on product ash.

FIG. 4 illustrates the influence of emulsification on product recovery.

Figures 5, 6:
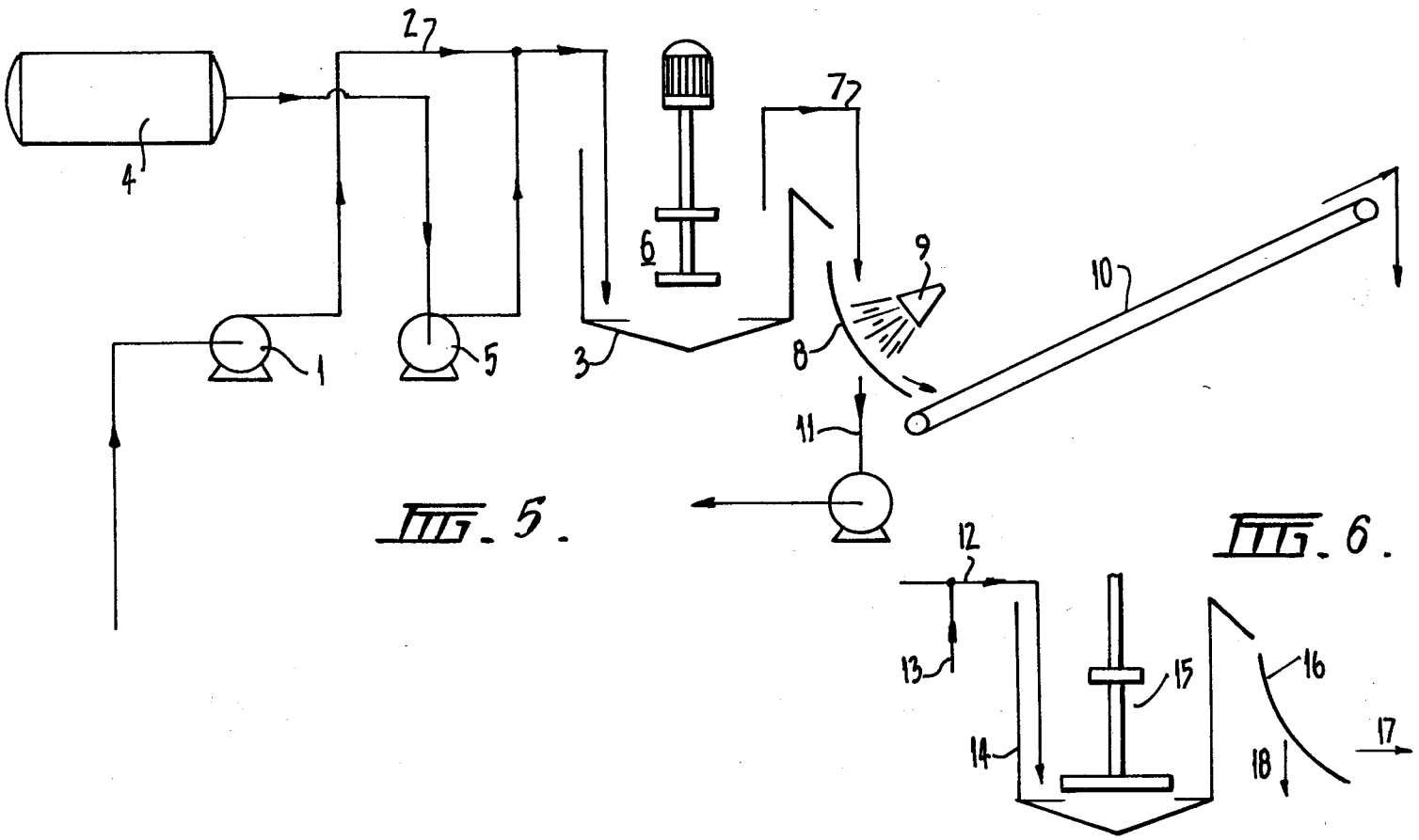
FIG. 5 is a schematic representation of a pilot plant operated in accordance with the invention.
FIG. 6 is a flow sheet illustrating a preferred embodiment of the invention.

The following account of experimental work is to be read in conjunction with the attached drawings FIGS. 1 to 4.

BACKGROUND EXPERIMENTAL WORK

A study was carried out to investigate the effect of emulsifying the oil before injection into the coal slurry. Full details are available in the paper by C. N. Bensley, A. R. Swanson and S. K. Nicol entitled *The Effect of Emulsification on the Selective Agglomeration of Fine*

*Coal.* (International Journal of Mineral Processing, Vol. 4, (1977), 173–184).

Two coal samples (denoted A and B) were used for this testwork and some of their physical characteristics are given in Table I. The specifications for the oils employed to produce agglomeration are shown in Table II. Experiments with Coal A were carried out in a 2 L beaker and used a Froude Number of 17.4. The pulp density was 10%. The agglomeration process was carried out for 20 minutes, as preliminary test work showed that this time was sufficient to allow the system to reach equilibrium (see FIG. 1). The product was separated from the tailings by a 0.6 mm screen.

A measure of the time required for agglomeration is the time taken to reach phase inversion. At this point, the power consumption of the stirrer reaches a maximum and thus the inversion time can be determined electronically. Coal B was used in inversion time experiments which were carried out in a 3 L beaker using a 40% pulp density and a Froude number of 9.7.

Froude Number ($N_{Fr}$) is defined by $$N_{Fr}=D\,N^2/g$$

where:

D is the impeller diameter in meters

N is the angular speed of the impeller in radians per second g is the acceleration due to gravity in meters per second per second.

TABLE I

Some Physical Characteristics of the Coal Samples

| Coal | Source | Raw Coal Ash(% db) | Size Data (wt %) +0.5 mm | −0.25 mm | −0.063 mm | Rosin Rammler Mean Size |
|---|---|---|---|---|---|---|
| A | Blended Steelworks Washery Stockpile | 22.0 | 24.2 | 48.1 | 16.6 | 0.35 mm |
| B | Southern NSW Colliery | 26.2 | 12.9 | 62.7 | 22.8 | 0.25 mm |

TABLE II

| Type of Oil | Oil Specifications Viscosity (cSt at 100° F.) | Specific Gravity (at 15° C.) |
|---|---|---|
| n-Heptane | 0.51 | .688 |
| Kerosene | 1.5 | .788 |
| Automotive Diesel | 2.53 | .8285 |
| Industrial Diesel Fuel | 2.64 | .842 |
| 50/50 Blend of Automotive Diesel & Heavy Fuel Oil | 10.28 | .88 |
| Heavy Fuel Oil | 38.05 | .931 |

The ease with which the emulsion droplets can be distributed throughout the slurry is a function of their size. To study this effect, emulsions with different drop size were prepared by mixing the water and oil phases in (1) a Turbula mixer for 1 hour (2) a Waring Blendor for 3 minutes at 1466 rad/s (14000 rpm)

(3) a Silverson Heavy Duty Laboratory Mixer/Emulsifier for 3 minutes at a setting to produce a free running speed of 1445 rad/s (13800 rpm).

The approximate dimensions of the emulsion droplets (as determined microscopically) produced by these various means are given in Table III. The size data can only be regarded as approximate owing to the unstable nature of the emulsions, i.e. some droplet coalescence occurred during transfer of the emulsion to the raw coal pulp although the transference operation was rapid. The emulsion preparation times were selected on the grounds of droplet size reproducibility and experimental convenience. In all cases emulsification occurred within the first few seconds of agitation.

TABLE III

Effect of Preparation on Emulsion Droplet Size

| Method of Preparation | Approximate Diameter (μm) |
|---|---|
| Turbula Mixer | 12 to 15 |
| Waring Blendor | 8 to 10 |
| Silverson Mixer/ Emulsifier | 3 to 5 |

FIG. 2 compares the effect of emulsification (Silverson Mixer) on the inversion time as a function of total oil addition with the corresponding trend for the case of unemulsified oil. Examination of the curves shows that emulsification drastically reduces the inversion time at low oil additions but its influence diminishes as the total oil addition increases.

Table IV illustrates the effect of using emulsified automotive diesel oil on inversion times. Inspection of the data suggests that the inversion time decreases with decreasing droplet size while Table 5 indicates that no corresponding difference in product ash and recovery are apparent.

FIGS. 3 and 4 illustrate the effect of oil emulsification (Silverson Mixer) on the product ash and the recovery of carbonaceous material measured by separation on a 0.6 mm screen. The results suggest that emulsification has no significant effect on the product ash. However a small improvement (~2 to 3%) in recovery of carbonaceous material is observed.

Table VI shows the effect of using different oils in the agglomeration procedure as measured by the inversion time criterion. If heavy oils are emulsified prior to addition to the raw coal pulp, the inversion time can be shortened considerably. For example, the inversion time for emulsified (10 wt %) heavy fuel oil is only 175 secs, compared to approximately 2000 secs for the unemulsified case.

TABLE IV

Effect of Emulsion Droplet Size on Inversion Time (Coal B, 10 wt % oil)

| Droplet Size (μm) | Inversion Time (secs) |
|---|---|
| Unemulsified | 250 |
| 12 to 15 | 190 |
| 8 to 10 | 120 |
| 3 to 5 | 105 |

TABLE V

Effect of Emulsion Droplet Size on Product Ash and Recovery (Coal A, 10 wt % oil)

| Droplet Size (μm) | Recovery of Organic Material (% dmmf) | Product Ash (% db) |
|---|---|---|
| Unemulsified | 95.9 | 15.0 |
| 12 to 15 | 96.6 | 15.0 |
| 3 to 5 | 96.6 | 15.1 |

TABLE VI

Effect of Oil Type on Inversion Time (Coal B, 10 wt % Oil)

| Type of Oil | Inversion Time (secs) |
|---|---|
| n-Heptane | 98 |
| Kerosene | 120 |
| Automotive Diesel | 180 |
| Heavy Fuel Oil/ Automotive Diesel Blend | ~210 |
| Heavy Fuel Oil | >2000 |

TABLE VII

Effect of Oil Type on Product Ash and Recovery (Coal A, 10 wt % oil)

| | Unemulsified Addition | | Emulsified Addition | |
|---|---|---|---|---|
| Oil Type | Product Ash (% db) | Recovery of Organic Material (% dmmf) | Product Ash (% db) | Recovery of Organic Material (% dmmf) |
| Kerosene | 14.9 | 93.9 | 15.1 | 94.2 |
| Automotive Diesel | 15.0 | 95.9 | 15.2 | 97.7 |
| Heavy Fuel Oil | 17.5 | 90.0 | 15.2 | 95.3 |

The corresponding effect on ash and recovery is illustrated in Table VII. The results show that the primary effect of using heavier oil is to increase inversion time and that provided sufficient time was allowed for the system to equilibrate, no adverse effects on ash rejection were observed. The apparent increase in product ash for unemulsified oils was attributed to this effect.

Although the practical operations of the present invention is in no way dependent upon any postulated theory as to the chemico-physical mechanisms involved, the following discussion is offered, it being clearly understood that the scope of the invention and of the claims defining same shall not be diminished or restricted in any way thereby.

The overall results suggest that the most striking effect of emulsification is on the kinetics of the process rather than the equilibrium properties of the system. The results presented in FIGS. 1 and 4 of Table VII imply that the principal effect of emulsification is to increase the efficiency with which the oil phase is mixed and distributed onto the surface of the coal particles. This view is also supported by the data in Table IV which, although only qualitative, suggests that decreasing the size of the emulsion droplets lead to even shorter inversion times. It appears that decreasing the droplet size to 3 to 5 μm carries no kinetic penalties through electrical double layer repulsion retarding the coalescence rate between oil droplets and coal particles.

Further interpretation of the data requires a process model. For this purpose it is convenient to consider the energetics of the overall process in terms of a number of simultaneously occurring energy consuming subprocesses. Consider the case in which the agglomeration is preformed with unemulsified oils. The expression for the energy used solely for agglomeration will include terms involving:

(1) "Emulsification" of the oil phase
(2) Entrainment of oil by coal particles
(3) Distribution of emulsified droplets
(4) Coalescence of emulsified droplets with coal particles
(5) Pendular flocculation of oil coated coal particles.
(6) Growth of agglomerates from flocculated nuclei.

If it is assumed that processes 1 and 2 are rate determining, the case for using pre-emulsified oil rests with the fact that emulsification can be achieved by more efficient methods. For example, it has been reported that the use of an ultrasonic emulsifier to produce 1 μm size droplets requires only 10% of the power required to produce droplets of a similar size by a conventional homogenizer. Furthermore, liquid jet generators are of simple and robust design and the only component which needs regular replacement is the vibrating blade which is a relatively simple operation involving a low cost item. We have found that such a device can be arranged so that the emulsion produced is injected directly into raw coal pulp stirred at only sufficient speed to give mixing. In this way the high wear rates and high attendant maintenance costs associated with high speed stirrers can be avoided.

The foregoing studies demonstrate that the efficiency of operation of the process and the quality of the clean coal product is dependent on several process parameters.

One of these parameters is the amount of oil required to cause inversion and the associated influence of oil type on selectivity. Although ash rejection is independent of the oil type used (provided that the oil is free from certain surface active materials), as heavier oils were tested so the inversion/residence tims increased. This would imply that if low cost heavy oils were to be used, a significant increase in reactor retention time would be required, and high stirrer speeds would also be essential. Both of these process needs would lead to high capital and operating costs. However, pre-emulsification of the oil significantly reduces both the energy required for inversion and the retention times for selective removal and agglomeration of the ultrafine coal.

Oil consumption was also found to be related to the size distribution of the coals present in the aqueous slurry. As the effectiveness of this operation is dependent on the surface area of the coal present, particularly with respect to agglomeration rates and growth, then more oil is required as the coal increases in fineness. Tests conducted on a range of NSW and Queensland coals demonstrated that most efficient separation and agglomeration was achieved for oil additions in the range 10 to 25% on a dry coal matter basis depending on the coals and coal size distributions tested. These results were obtained for a diversity of hydro-carbon oils ranging in density from naphtha to heavy fuel oils and waste lubricating oils.

As indicated above one of the prerequisites of the process is to produce a clean coal agglomerate which is readily separable from the mineral matter containing water phase by using simple dewatering screens. To achieve suitable sized agglomerates, with minimal fine coal reporting to the screen underflow, we have found that a specific shear regime is required in the reactor vessel to ensure both adequate opportunities for collision of the oiled coal particles (agglomerate seeding and growth) and for densification and compaction of the agglomerates to yield a product of sufficient strength to withstand the subsequent screening separation. Accordingly in a preferred embodiment of the invention successful operations were achieved using a range of reactor vessel sizes and for varying shear regimes as defined by a range of Froude numbers increasing from a minimum value of 2 to a maximum of 600.

This range of Froude numbers corresponds to much lower impeller speeds than have been previously reported by other workers in this field. As a result of these lower impeller speeds suitably large agglomerates of sufficient physical integrity to withstand screening can be produced at the hydrocarbon oil additions employed.

PILOT PLANT DEVELOPMENT

Based on the results of the bench scale studies a 0.5 ton per hour plant was designed to continuously treat underflow slurries from a jigging plant. The pilot plant is described schematically below in FIG. 5.

The coal containing slurry is pumped from an intermediate holding-receiving tank (not shown) by slurry feed pump 1 via feed pipe 2 to the agglomeration reactor 3. Oil flows from tank 4 via pump/emulsifier 5, by which the aqueous emulsion is produced, into the slurry feed pipe 2 as shown, or alternatively may be added directly into the reactor 3. Agitation in the reactor is provided by impeller 6. The addition of the pre-emulsified oil is regulated according to the mass flow rate of the solids in the slurry feed, the ratio being adjusted by the reactor output. The agglomerated coal product and underflow tailings are discharged as an overflow 7 from the reactor onto the curved dewatering screen 8 which is fitted with water sprays 9 to improve demineralisation of the agglomerate product. The clean coal product discharges from the screen onto the product belt line 10 while the tailings slurry, essentially stripped of coal matter, passes through the screen as at 11 and is discharged to settling ponds.

The tailings underflow has been found to settle rapidly and contains little visible coaly material. As such this material is an environmentally acceptable material.

Typical operating data obtained in the pilot plant trails are:

| Operating data obtained in the Pilot Plant Trials | |
|---|---|
| (a) Feed | |
| Essentially 100% passing | 0.150 mm |
| Ash content (% db) | 35 to 45 |
| Pulp density (wt %) | 25 to 50 |
| (b) Process Variables | |
| Residence time in tank (min) | 15 |
| Oil addition level (wt % dry product) | 10 to 25 |
| Product ash (% db) | 8 to 13 |
| Tailings ash (% db) | 70 to 87 |

-continued

| Operating data obtained in the Pilot Plant Trials | |
|---|---|
| Coal material Recovery (%) | 80 to 95 |

| Reactor Details | |
|---|---|
| Capacity | 380 liters |
| Diameter | 0.7 meter |
| Angle at cone | 45° |
| Impeller | 2 blade, rearward swept 45° Diameter 430 mm |
| Froude Number | 40 to 200 |
| Aperture of Wedge Wire screen | 0.25, 0.5 mm |

In a preferred embodiment the operating data in the same reactor were as follows:

| | |
|---|---|
| (a) Feed | |
| Essentially 100% passing | 0.150 mm |
| Ash content (% db) | 37.5 |
| Pulp density (wt %) | 48 |
| (b) Process Variables | |
| Feed rate (tonne/hr. dry solids) | 0.502 |
| Residence time in tank (min) | 15 |
| Oil addition level (wt % dry product) | 16 |
| Product rate (tonne/hr. dry solids) | 0.327 |
| Product ash (% db) | 10.9 |
| Product moisture (wt %) | 15 |
| Tailings ash (% db) | 87 |
| Coal material Recovery (%) | 93 |
| Froude Number | 120 |
| Aperture of Wedge Wire screen | 0.5 mm |

The proportion of oil in the emulsion is not critical and the process of the present invention has been successfully operated with aqueous emulsions containing as little as 5% oil by volume. It has been found convenient to use emulsions containing 5 to 20% oil by volume.

In the preferred embodiment illustrated by FIG. 6 line 12 represents a pipe or launder flow of refuse slurry either directly from a coal washery, from some sort of settling/clarifying device (e.g. cone thickener) or from a tailings pond. A hydrocarbon stream 13 is added to the waste stream 12 before it enters the reactor vessel 14. Our experiments (Bensley, Swanson and Nicol, *The Effect of Emulsification on the Selective Agglomeration of Fine Coal,* International Journal of Mineral Processing, 4 (1977), 173–184), have shown that it is kinetically preferable to emulsify the hydrocarbon prior to its addition to the refuse slurry stream. The type of emulsion used is also considered to be important. Our researches have shown that the emulsion must be "unstable" in the surface chemical sense otherwise kinetic restrictions resulting from such factors as electrical double layer interaction and film thinning considerations (see Derjaguin, Landau, Verwey, Overbeek 1948), can lead to increased power consumption. To produce such an emulsion we rely on the use of a physical method such as an ultrasonic whistle rather than the common method of using emulsifying agents. Furthermore the use of chemical emulsifying agents can have a deleterious effect because their adsorption onto the surface of the mineral particles and render them hydrophobic. The result of this is that these will now report with the oil phase and produce a higher ash content in the agglomerates. The mixed stream is passed to the reactor vessel where agitation is provided by a stirring mechanism 15, which produces the agglomerates. Slurry, containing agglomerates, over-flows onto a sieve bend or inclined screen 16 where the agglomerates of coal and oil are separated from the tailings. The product stream 17 comes off the bottom of the screen whilst the tailings 18 fall through the screen and are passed to tailings disposal.

As indicated above, the level of oil addition 13 depends upon a number of variables but efficient operation is achieved by using an addition rate in the range 10 to 25% on a dry coal matter basis. The preferred oils lie in the boiling range of kerosene to industrial diesel fuel (see Table II for properties).

Further preferred embodiments of the invention are illustrated by the following examples:

EXAMPLE 1

A sample of tailings thickener underflow from a coal preparation plant treating bituminous coals by Drewboys dense media baths, shaking tables and froth flotation was obtained. This material had an ash content of 41.5% (db) and a size analysis of the material showed that on a weight basis 93.8% passed 76 μm and 88.0% passed 53 μm. The slurry treated contained 12% solids by weight.

Tests were carried out in a one liter beaker with a kerosene addition rate of 18 wt% and the results can be seen in Table VIII. Separation was carried out on a 0.152 mm sieve. From these results it can be seen that high recoveries of coal can be achieved at low product ash levels.

TABLE VIII

| Froude Number | Yield (wt %) | Product Ash (wt % db) | Tail Ash (wt % db) | Recovery of Coal mat'l (wt %) |
|---|---|---|---|---|
| 6.24 | 25.6 | 5.2 | 55.2 | 41.5 |
| 17.34 | 44.3 | 4.7 | 72.0 | 72.2 |
| 44.40 | 53.6 | 5.5 | 84.0 | 86.6 |

EXAMPLE 2

A sample of refuse slurry was taken from a preparation plant that treated a sub bituminous coal by coarse and fine jigs. The sample was the underflow of a cone thickener which is usef to clarify plant process water and contained 26% solids by weight. The material had a raw coal ash of 38.1% and had 58.2% by weight passing a 63 μm screen. By conditioning and adding diesel the results shown in Table IX were obtained on a bench scale. The agglomerates in this case were separated from the tailings on a 0.5 mm woven wire screen.

TABLE IX

| Froude Number | Diesel addition (wt % dry coal basis) | Yield (wt %) | Product Ash (wt %, adb) | Tailings Ash (wt %, adb) |
|---|---|---|---|---|
| 11 | 14.4 | 75.4 | 22.0 | 82.3 |
| 11 | 11.0 | 73.8 | 24.5 | 80.0 |

EXAMPLE 3

A reject slurry pond of a colliery jigging plant was sampled to provide another selective agglomeration feed. The slurry contained 21% solids by weight. The material had a raw coal ash of 35.7% and 59.3% by weight of the material passed 152 μm screen. By using 20.8% kerosene on product basis, a Froude number of 17.3 in a one liter beaker and a 0.5 mm screen for product collection, a yield of 61.6% was obtained with product and tailing ashes of 16.0 and 76.8% (db) respectively.

EXAMPLE 4

A slurry from the same source as Example 3 and containing 33% solids by weight was agglomerated in a one liter mixer using a Froude number of 503.6 and a diesel addition rate of 18.1% on a product basis. The product was collected on a 0.3 mm screen. The yield was 59.4% whilst the product and tailings ashes were 9.9% and 72.5% respectively.

We claim:

1. A process for continuously producing agglomerated coal from coal fines, which comprises treating an aqueous slurry of the coal files by (a) forming an unstable oil-in-water emulsion, (b) continuously mixing in a vessel the unstable oil-in-water emulsion, in an amount of from about 10 to about 25% by weight of the oil, calculated on a dry coal matter basis, into the slurry under conditions of non-intensive agitation corresponding to a Froude number of 2 to 600 with a residence time in the vessel of at least 15 minutes and for a time at least sufficient to reach phase inversion to form dense, large agglomerates of said coal fines, and (c) thereafter essentially stripping the aqueous slurry of coal matter by removing the agglomerated coal fines from the remainder of the aqueous slurry.

2. A process according to claim 1 in which the aqueous slurry contains at least 12% solids by weight.

3. A process according to claim 2 in which the aqueous slurry contains at least 25% solids by weight.

4. A process according to claim 1, wherein the unstable oil-in-water emulsion is mixed into said slurry by an impeller.

5. A process according to claim 4 in which the Froude number is from 40 to 200.

6. A process according to claim 1 in which the agglomerates are recoverable on a screen of aperture from 0.15 to 0.5 mm.

7. In a process for continuously producing agglomerated coal from coal fines, said process comprising treating an aqueous slurry of the coal fines by mixing oil with the aqueous slurry of coal fines in a vessel under conditions of agitation to form fine coal agglomerates, and thereafter removing the agglomerated coal fines from the remainder of the aqueous slurry, the improvement comprising utilizing an oil in the form of an unstable oil-in-water emulsion, and mixing the emulsified oil in an amount of from about 10 to about 25% by weight of the oil, calculated on a dry coal matter basis, into the slurry under conditions of non-intensive agitation corresponding to a Froude number of 2 to 600 for a time at least sufficient to reach phase inversion and for at least 15 minutes residence time in the vessel, to form dense, large fine coal agglomerates which can be readily removed from the remainder of the aqueous slurry.

8. A process according to claim 7 in which the slurry contains at least 35% solids by weight and the Froude number is from 40 to 200.

9. A process according to 7 in which the agglomerates are recoverable on a screen of aperture from 0.15 to 0.5 mm.

10. The product of a process according to 7.

11. A process according to claim 7, wherein said unstable oil-in-water emulsion contains about 5 to about 20 volume percent of oil, said oil having a viscosity of at least about 1.5 cSt at 100° F.

12. A process for continuously producing agglomerated coal from bituminous coal fines, which comprises treating an aqueous slurry containing at least 12% by weight of the coal fines by (a) forming an unstable oil-in-water emulsion of an oil having a viscosity of at least about 1.5 cSt at 100° F., (b) continuously mixing in a vessel the unstable oil-in-water emulsion, in an amount of from about 10 to about 25% by weight of oil, calculated on a dry coal matter basis, into the slurry under conditions of non-intensive agitation corresponding to a Froude number of 2 to 600 with a residence time in the vessel of at least 15 minutes and for a time at least sufficient to reach phase inversion, to form dense, large agglomerates of said coal fines, and (c) removing said agglomerates from the remaining aqueous slurry by use of a wedge wire screen having an aperture of at least about 0.15 mm to produce a screen tailing which is essentially stripped of coal matter.

* * * * *